United States Patent [19]

Kaugars

[11] 4,169,595

[45] Oct. 2, 1979

[54] LIGHT WEIGHT GOLF CLUB SHAFT

[75] Inventor: Eugene Kaugars, Torrington, Conn.

[73] Assignee: Brunswick Corporation, Skokie, Ill.

[21] Appl. No.: 760,518

[22] Filed: Jan. 19, 1977

[51] Int. Cl.[2] ..... A63B 53/12

[52] U.S. Cl. ..... 273/80 R; 273/77 A

[58] Field of Search ..... 273/77 R, 77 A, 80 R, 273/80 B; 148/36

[56] References Cited

U.S. PATENT DOCUMENTS

| | | | |
|---|---|---|---|
| 1,670,531 | 5/1928 | Cowdery | 273/80 B |
| 1,765,709 | 6/1930 | Withington | 273/80 B |
| 1,974,389 | 9/1934 | Cowdery | 273/80 B |
| 2,037,636 | 4/1936 | Lagerblade | 273/80 B |
| 2,822,174 | 2/1958 | Brandon | 273/77 A X |
| 3,809,403 | 5/1974 | Hunter | 273/80 B |
| 3,834,700 | 9/1974 | Auerbach | 273/80 R X |
| 3,871,649 | 3/1975 | Kilshaw | 273/77 A |
| 4,058,312 | 11/1977 | Stuff et al. | 273/77 A |
| 4,125,260 | 11/1978 | Kanne et al. | 273/80 R |

OTHER PUBLICATIONS

"The Sporting Goods Dealer", Jun. 1971, pp. 68 and 70.

"Golf Digest", Mar. 1972, pp. 10 and 11.

"Golf World", Jan. 24, 1975, p. 26.

"Kenneth Smith Golf Catalog", 1969, p. 10.

*Primary Examiner*—Richard J. Apley

*Attorney, Agent, or Firm*—John G. Heimovics

[57] ABSTRACT

A light weight golf club shaft and a method of making it out of metal tubing are described. The metal must have, after heat treatment, a yield strength equal to or greater than 220,000 lbs./in.$^2$ to avoid permanent shaft deflection in use. The metal must also have an ultimate strength equal to or greater than 240,000 lbs./in.$^2$ to avoid shaft breakage in use. The finished shaft must attain the impact and permanent set results set forth in the specification. To fabricate the shaft in a variety of lengths and flex patterns needed to accommodate a golfer's individual needs, a collection of manufacturing specifications incorporating relationships between the working material, the initial size of the work piece, and the final shaft product length, taper, weight, and flex are presented. A test is defined for measuring the final shaft product's flex pattern.

15 Claims, 13 Drawing Figures

| O.A.L. | A | FINISH W. ±.10 OZ. | BILL OF MATERIAL | | | | | | |
|---|---|---|---|---|---|---|---|---|---|
| | | | O.D. | TUBE WEIGHT | TUBE L. | G.L. | H.L. | GRIP WALL | HOSEL WALL |
| 39 1/2 | 13 1/2 | 3.60 | .598-.600 | 3.82 ± .04 OZ. | 37 1/2 | 32 | 5 1/2 | .0113 ± | .017+.0005,-.0000 |
| 39 | 13 | 3.60 | .598-.600 | 3.82 ± .04 | 37 | 31 1/2 | 5 1/2 | .0115 ± | .017+.0005,-.0000 |
| 38 1/2 | 12 1/2 | 3.60 | .598-.600 | 3.82 ± .04 | 36 1/2 | 31 | 5 1/2 | .0117 ± | .017+.0005,-.0000 |
| 38 | 12 | 3.60 | .598-.600 | 3.82 ± .04 | 36 | 30 1/2 | 5 1/2 | .0119 ± | .017+.0005,-.0000 |
| 37 1/2 | 11 1/2 | 3.60 | .598-.600 | 3.82 ± .04 | 35 1/2 | 30 | 5 1/2 | .0121 ± | .017+.0005,-.0000 |
| 37 | 11 | 3.60 | .598-.600 | 3.82 ± .04 | 35 1/8 | 29 1/8 | 6 | .0122 ± | .017+.0005,-.0000 |
| 36 1/2 | 10 1/2 | 3.60 | .598-.600 | 3.82 ± .04 | 34 5/8 | 28 5/8 | 6 | .0124 ± | .017+.0005,-.0000 |
| 36 | 10 | 3.60 | .598-.600 | 3.82 ± .04 | 34 1/4 | 28 1/4 | 6 | .0126 ± | .017+.0005,-.0000 |
| 35 1/2 | 9 1/2 | 3.60 | .598-.600 | 3.82 ± .04 | 33 7/8 | 27 7/8 | 6 | .0128 ± | .017+.0005,-.0000 |
| 35 | 9 | 3.60 | .598-.600 | 3.82 ± .04 | 33 3/8 | 27 3/8 | 6 | .013 ± | .017+.0005,-.0000 |

NOTES:
1. ALL DIMENSIONS ARE AS PLATED UNLESS OTHERWISE NOTED
2. DIAMETERS TO BE HELD WITHIN ±.002" UNLESS OTHERWISE NOTED
3. GRIP END UNPLATED 8 ± 1/2"

4. PERM. SET:

| W | B | S |
|---|---|---|
| 22 | 2 | .100 |

S-FLEX IRON SHAFT

FIG. 1

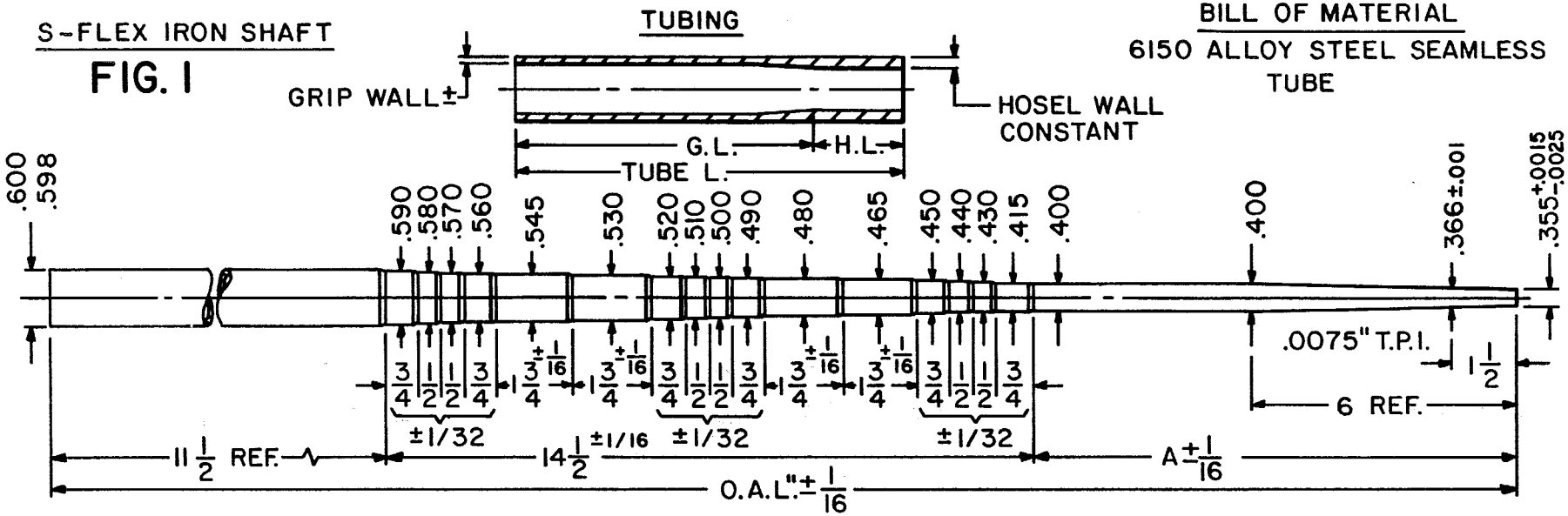

BILL OF MATERIAL

6150 ALLOY STEEL SEAMLESS TUBE

| O.A.L. | A | FINISH W. ±.10 OZ. | BILL OF MATERIAL | | | | | | |
|---|---|---|---|---|---|---|---|---|---|
| | | | O.D. | TUBE WEIGHT | TUBE L. | G.L. | H.L. | GRIP WALL | HOSEL WALL |
| 39 1/2 | 13 1/2 | 3.60 | .598-.600 | 3.82 ± .04 OZ. | 37 1/2 | 32 | 5 1/2 | .0113 ± | .017+.0005,-.0000 |
| 39 | 13 | 3.60 | .598-.600 | 3.82 ± .04 | 37 | 31 1/2 | 5 1/2 | .0115 ± | .017+.0005,-.0000 |
| 38 1/2 | 12 1/2 | 3.60 | .598-.600 | 3.82 ± .04 | 36 1/2 | 31 | 5 1/2 | .0117 ± | .017+.0005,-.0000 |
| 38 | 12 | 3.60 | .598-.600 | 3.82 ± .04 | 36 | 30 1/2 | 5 1/2 | .0119 ± | .017+.0005,-.0000 |
| 37 1/2 | 11 1/2 | 3.60 | .598-.600 | 3.82 ± .04 | 35 1/2 | 30 | 5 1/2 | .0121 ± | .017+.0005,-.0000 |
| 37 | 11 | 3.60 | .598-.600 | 3.82 ± .04 | 35 1/8 | 29 1/8 | 6 | .0122 ± | .017+.0005,-.0000 |
| 36 1/2 | 10 1/2 | 3.60 | .598-.600 | 3.82 ± .04 | 34 5/8 | 28 5/8 | 6 | .0124 ± | .017+.0005,-.0000 |
| 36 | 10 | 3.60 | .598-.600 | 3.82 ± .04 | 34 1/4 | 28 1/4 | 6 | .0126 ± | .017+.0005,-.0000 |
| 35 1/2 | 9 1/2 | 3.60 | .598-.600 | 3.82 ± .04 | 33 7/8 | 27 7/8 | 6 | .0128 ± | .017+.0005,-.0000 |
| 35 | 9 | 3.60 | .598-.600 | 3.82 ± .04 | 33 3/8 | 27 3/8 | 6 | .013 ± | .017+.0005,-.0000 |

NOTES:

1. ALL DIMENSIONS ARE AS PLATED UNLESS OTHERWISE NOTED
2. DIAMETERS TO BE HELD WITHIN ±.002" UNLESS OTHERWISE NOTED
3. GRIP END UNPLATED 8 ± 1/2"
4. PERM. SET:

| W | B | S |
|---|---|---|
| 22 | 2 | .100 |

| O.A.L. | A | FINISH W. ±.10 OZ. | BILL OF MATERIAL O.D. | TUBE WEIGHT | TUBE L. | G.L. | H.L. | GRIP WALL | HOSEL WALL |
|---|---|---|---|---|---|---|---|---|---|
| 39 1/2 | 14 1/2 | 3.40 | .578-.580 | 3.58 ±.04 OZ. | 37 1/2 | 32 | 5 1/2 | .0109± | .017+.0005,-.0000 |
| 39 | 14 | 3.40 | .578-.580 | 3.58 ±.04 | 37 | 31 1/2 | 5 1/2 | .0111 ± | .017+.0005,-.0000 |
| 38 1/2 | 13 1/2 | 3.40 | .578-.580 | 3.58 ±.04 | 36 1/2 | 31 | 5 1/2 | .0113 ± | .017+.0005,-.0000 |
| 38 | 13 | 3.40 | .578-.580 | 3.58 ±.04 | 36 | 30 1/2 | 5 1/2 | .0115 ± | .017+.0005,-.0000 |
| 37 1/2 | 12 1/2 | 3.40 | .578-.580 | 3.58 ±.04 | 35 1/2 | 30 | 5 1/2 | .0117 ± | .017+.0005,-.0000 |
| 37 | 12 | 3.40 | .578-.580 | 3.58 ±.04 | 35 1/8 | 29 1/8 | 6 | .0117 ± | .017+.0005,-.0000 |
| 36 1/2 | 11 1/2 | 3.40 | .578-.580 | 3.58 ±.04 | 34 5/8 | 28 5/8 | 6 | .0119 ± | .017+.0005,-.0000 |
| 36 | 11 | 3.40 | .578-.580 | 3.58 ±.04 | 34 1/4 | 28 1/4 | 6 | .0121 ± | .017+.0005,-.0000 |
| 35 1/2 | 10 1/2 | 3.40 | .578-.580 | 3.58 ±.04 | 33 7/8 | 27 7/8 | 6 | .0123 ± | .017+.0005,-.0000 |
| 35 | 10 | 3.40 | .578-.580 | 3.58 ±.04 | 33 3/8 | 27 3/8 | 6 | .0125 ± | .017+.0005,-.0000 |

NOTES:
1. ALL DIMENSIONS ARE AS PLATED UNLESS OTHERWISE NOTED
2. DIAMETERS TO BE HELD WITHIN ±.002" UNLESS OTHERWISE NOTED
3. GRIP END UNPLATED 8 ±1/2"
4. PERM. SET:

| W | B | S |
|---|---|---|
| 22 | 2 | .100 |

BILL OF MATERIAL
6150 ALLOY STEEL SEAMLESS TUBE

L-FLEX IRON SHAFT

| BILL OF MATERIAL | | | | | |
|---|---|---|---|---|---|
| O.A.L. | A | FINISH W. ±.10 OZ. | O.D. | TUBE WEIGHT | TUBE L. | TUBE WALL |
| 39 1/2 | 14 | 3.40 | .538-.540 | 3.58 ±.02 OZ. | 38 | .0126 REF. |
| 39 | 13 1/2 | 3.40 | .538-.540 | 3.58 ±.02 | 37 1/2 | .0127 REF. |
| 38 1/2 | 13 | 3.40 | .538-.540 | 3.58 ±.02 | 37 | .0129 REF. |
| 38 | 12 1/2 | 3.40 | .538-.540 | 3.58 ±.02 | 36 1/2 | .0131 REF. |
| 37 1/2 | 12 | 3.40 | .538-.540 | 3.58 ±.02 | 36 | .0133 REF. |
| 37 | 11 1/2 | 3.40 | .538-.540 | 3.58 ±.02 | 35 5/8 | .0134 REF. |
| 36 1/2 | 11 | 3.40 | .538-.540 | 3.58 ±.02 | 35 1/8 | .0136 REF. |
| 36 | 10 1/2 | 3.40 | .538-.540 | 3.58 ±.02 | 34 3/4 | .0138 REF. |

4. PERM. SET:

| W | B | S |
|---|---|---|
| 17 | 2 | .100 |

NOTES:
1. ALL DIMENSIONS ARE AS PLATED UNLESS OTHERWISE NOTED
2. DIAMETERS TO BE HELD WITHIN ±.002" UNLESS OTHERWISE NOTED
3. GRIP END UNPLATED 8 ±1/2"

X-FLEX WOOD SHAFT

BILL OF MATERIAL

6150 ALLOY STEEL SEAMLESS TUBE

| O.A.L. | A | B | FINISH W. ±.0625 OZ. | O.D. | TUBE WEIGHT | TUBE L. | TUBE WALL |
|---|---|---|---|---|---|---|---|
| 45 | 8 3/4 | 12 1/4 | 3.80 | .618-.620 | 3.98 ± .02 OZ. | 42 3/4 | .0107 REF. |
| 44 | 8 3/4 | 11 1/4 | 3.80 | .618-.620 | 3.98 ± .02 | 41 3/4 | .011 REF. |
| 43 | 8 3/4 | 10 1/4 | 3.80 | .618-.620 | 3.98 ± .02 | 40 3/4 | .0113 REF. |
| 42 | 8 3/4 | 9 1/4 | 3.80 | .618-.620 | 3.98 ± .02 | 39 3/4 | .0116 REF. |

NOTES:
1. ALL DIMENSIONS ARE AS PLATED UNLESS OTHERWISE NOTED
2. DIAMETERS TO BE HELD WITHIN ±.002" UNLESS OTHERWISE NOTED
3. GRIP END UNPLATED 8±1/2"
4. PERM. SET:

| W | B | S |
|---|---|---|
| 13 | 4 | .100 |

S-FLEX WOOD SHAFT

| BILL OF MATERIAL | | | | | | |
|---|---|---|---|---|---|---|
| O.A.L. | A | B | FINISH W. ±.10 OZ. | O.D. | TUBE WEIGHT | TUBE L. | TUBE WALL |
| 45 | 8 3/4 | 14 1/4 | 3.60 | .598-.600 | 3.84 ± .02 OZ. | 42 3/4 | .0107 REF. |
| 44 | 8 3/4 | 13 1/4 | 3.60 | .598-.600 | 3.84 ± .02 | 41 3/4 | .0109 REF. |
| 43 | 8 3/4 | 12 1/4 | 3.60 | .598-.600 | 3.84 ± .02 | 40 3/4 | .0112 REF. |
| 42 | 8 3/4 | 11 1/4 | 3.60 | .598-.600 | 3.84 ± .02 | 39 3/4 | .0115 REF. |

NOTES:
1. ALL DIMENSIONS ARE AS PLATED UNLESS OTHERWISE NOTED
2. DIAMETERS TO BE HELD WITHIN ±.002" UNLESS OTHERWISE NOTED
3. GRIP END UNPLATED 8 ± 1/2"
4. PERM. SET:

| W | B | S |
|---|---|---|
| 12 | 4 | .100 |

BILL OF MATERIAL
6150 ALLOY STEEL SEAMLESS TUBE

R-FLEX WOOD SHAFT

| BILL OF MATERIAL | | | | | | |
|---|---|---|---|---|---|---|
| O.A.L. | A | B | FINISH W. ±.10 OZ. | O.D | TUBE WEIGHT | TUBE L. | TUBE WALL |
| 45 | 9 3/4 | 13 1/4 | 3.40 | .598-.600 | 3.60 ±.02 OZ. | 42 3/4 | .010 REF. |
| 44 | 9 3/4 | 12 1/4 | 3.40 | .598-.600 | 3.60 ±.02 | 41 3/4 | .0103 REF. |
| 43 | 9 3/4 | 11 1/4 | 3.40 | .598-.600 | 3.60 ±.02 | 40 3/4 | .0105 REF. |
| 41 | 9 3/4 | 10 1/4 | 3.40 | .598-.600 | 3.60 ±.02 | 39 3/4 | .0108 REF. |

NOTES:
1. ALL DIMENSIONS ARE AS PLATED UNLESS OTHERWISE NOTED
2. DIAMETERS TO BE HELD WITHIN ±.002" UNLESS OTHERWISE NOTED
3. GRIP END UNPLATED 8±1/2"
4. PERM. SET:

| W | B | S |
|---|---|---|
| 12 | 4 | .100 |

BILL OF MATERIAL

6150 ALLOY STEEL SEAMLESS TUBE

L-FLEX WOOD SHAFT

| O.A.L. | A | B | FINISH W. ±.10 OZ. | BILL OF MATERIAL O.D. | TUBE WEIGHT | TUBE L. | TUBE WALL |
|---|---|---|---|---|---|---|---|
| 44 | 8 | 14 | 3.40 | .558-.560 | 3.64 ± .02 OZ. | 41 3/4 | .0111 REF. |
| 43 | 8 | 13 | 3.40 | .558-.560 | 3.64 ± .02 | 40 3/4 | .0114 REF. |
| 42 | 8 | 12 | 3.40 | .558-.560 | 3.64 ± .02 | 39 3/4 | .0117 REF. |
| 41 | 8 | 11 | 3.40 | .558-.560 | 3.64 ± .02 | 38 3/4 | .012 REF. |

NOTES:
1. ALL DIMENSIONS ARE AS PLATED UNLESS OTHERWISE NOTED
2. DIAMETERS TO BE HELD WITHIN ±.002" UNLESS OTHERWISE NOTED
3. GRIP END UNPLATED 8 ±1/2"
4. PERM. SET:

| W | B | S |
|---|---|---|
| 12 | 4 | .100 |

BILL OF MATERIAL
6150 ALLOY STEEL SEAMLESS TUBE

LIGHT WEIGHT GOLF CLUB SHAFT

SUMMARY OF THE INVENTION

Experts agree that the theoretically ideal golf club would have all its weight concentrated in the club head and have a shaft and grip of negligible weight. In such an ideal club all the swing effort of the golfer would then be concentrated as kinetic energy in the club head for transfer to the ball. While in practice it is not possible to achieve a satisfactory club with shafts of negligible weight, considerable effort has been made in recent years to produce shafts that perform and play like standard weight golf club shafts but are of considerably lighter weight.

For example, while a standard carbon alloy steel golf club shaft might typically have a weight of 4.4 ounces, by going to such exotic materials as graphite fibers, shafts have been produced having weights in the range 2.9–3.5 ounces; and perhaps even lower weights can be obtained with even more exotic material.

However, a satisfactory light weight shaft is not merely one having an acceptable weight: it must also perform and play in a manner competitive with shafts of conventional weights. Those light weight shafts that have been produced to date have been subject to a multitude of disadvantages in whole or in part stemming from their light weight construction or the material used. For example, aluminum is a light weight material, but while shafts made of this material are initially suitably resilient, with use they become fatigued, resulting in "soft" shafts of reduced spring.

Another promising light weight shaft material now marketed widely is graphite fiber. These shafts have been of limited success because of two major complaints made by golfers: graphite shafts have an excessively "whippy" action and are not as "twist resistant" as conventional shafts of carbon alloy steel. Thus the golfer must exercise additional precaution in his swing to compensate for the liveliness of the graphite shaft while adjusting to the new feedback sensations he feels while holding this club.

Were cost not a factor, more manufacturers might offer titanium shafts, but the material for these shafts is both expensive to obtain and difficult to fabricate, resulting in typical quantity prices of $23 and up.

Therefore, the golf shaft industry has long sought a suitable material available at reasonable price that can be fabricated at a competitive cost into a light weight shaft performing and playing as well or better than conventional weight shafts.

Thus, one of the objectives of my invention is to identify and prove the feasibility of using conventionally available materials for golf club shafts of less than conventional weights and wall thicknesses that perform and play as well or better than conventional weight shafts.

Another objective of my invention is to discover a method of fabricating a golf club shaft of less than conventional weight and wall thickness that uses a reasonably priced material, the shaft being able to perform and play as well or better than conventional weight shafts.

It is a further objective of my invention to discover design criteria for such light weight shafts in families of lengths for wood and iron club heads and determine how to modify the criteria to produce families of shafts having a preselected flex pattern to satisfy different golfers' preferences for stiff, regular, and ladies' flexes.

An important objective of my invention that will make it more commercially competitive is to translate the design criteria into actual shaft configurations that will achieve the design criteria at a reasonable cost while meeting the high appearance standards for shafts usually expected by club manufacturers, merchandisers, and players.

A further objective of my invention is a golf club shaft fabricated from materials that permit the shaft to be of lighter weight than conventional shafts because of a thinner average wall thickness and yet perform and play as well or better than conventional shafts. In more detail, this objective includes a family of such shafts of different lengths to accommodate all the wood and iron heads of a full golf club set, the shafts being available in a full range of flexes to satisfy different golfers' preferences for stiff, regular, and ladies' flexes.

I believe that my new shaft, which I call UCV-304 TM, does meet these objectives. My belief is based on actual laboratory tests, favorable field tests, and sales made in the short period of less than a year before filing this patent application.

In an indoor laboratory test my UCV-304 TM shaft was attached to a 1975 MT TM driver and compared with other shafts fitted with the same driver head. Here is how my new shaft compared with two standard weight alloy steel shafts, Propel I TM and Propel II TM, a somewhat lighter weight alloy steel shaft, Protaper TM, and a comparably light graphite shaft manufactured by EXXON TM.

COMPARATIVE SHAFT PERFORMANCE (11° DRIVE - S FLEX MODELS)

| MODEL | SHAFT WEIGHT OZ. | BALL VELOCITY FT./SEC. | CLUB HEAD VELOCITY FT./SEC. | BALL SPIN RATE REV./SEC. | BALL LAUNCH ANGLE |
|---|---|---|---|---|---|
| UCV-304TM | 3.45 | 233.60 | 155.03 | 56.95 | 8.57° |
| PROPEL 1TM | 4.37 | 230.00 | 152.61 | 67.48 | 7.98 |
| PROPEL IITM | 4.42 | 227.80 | 153.14 | 56.94 | 7.80 |
| PROTAPERTM | 3.98 | 232.00 | 154.14 | 66.91 | 8.35 |
| GRAFTEKTM (EXXON) | 2.96 | 234.20 | 157.30 | 54.71 | 8.17 |

As can be seen above, in spite of its lighter weight, the UCV-304 TM compared favorably with the heavier shafts and the graphite shaft. Note that in this test each shaft was fitted with the same 1975 MT TM driver, whereas the light weight of the UCV-304 shaft would have permitted a heavier than average club head if the characteristic identical for each club was total club weight.

Although this shaft was first offered for sale less than 1 year before the filing of this patent application, sales have exceeded 30,000 units, in effect creating a new submarket for such light weight steel clubs where none existed before. I sell my shaft at a profit for about $6–$7 (depending on quantity), whereas graphite shafts typically sell for $15–$45. Thus a purchaser of my shaft can have the advantages of light weight and metal construction without paying the premium prices graphite shafts command.

My invention can be roughly summarized as the discovery of how to make each light weight metal golf club shaft of a set have the performance and playing characteristics of conventional weight steel shafts but the following weights:

TABLE I

| CLUB TYPE | FLEX PATTERN X | S | R | L |
|---|---|---|---|---|
| WOOD | 3.8 oz. | 3.6 oz. | 3.4 oz. | 3.4 oz. |
| IRON | | 3.6 oz. | 3.4 oz. | 3.4 oz. |

The secret of the invention (which I discovered by a combination of calculation, estimation, experimentation, and serendipity) is that I use:

(a) metal which has, after heat treatment, a yield strength equal to or greater than 220,000 lbs./in.$^2$ and an ultimate strength equal to or greater than 240,000 lbs./in.$^2$ (b) the relationship between the final shaft lengths and the starting work-piece sizes shown in FIGS. 1–7.

(c) the shaft tapers shown in FIGS. 1–7 or tapers with an equivalent outer envelope (d) the relationship between the final shaft flex pattern and the other parameters as shown in FIGS. 1–7

(e) the permanent set test criteria shown in FIGS. 1–7

(f) an impact test criteria of at least 10 ft./lbs. when applied to any point along the shaft It should be noted that while the above interrelated elements of my invention are now set down here in relatively compact, orderly fashion, their discovery did not follow any simple rule or pattern. The reason is that while some of the properties of golf club shafts can be calculated theoretically from a description of a proposed shaft, many of the most important dynamic tests of golf club shafts are either hard to model mathematically (such as the complex sequence of events that occurs when a typical player tees off) or involve the psychophysics of a player's body (e.g. the "feel" of a shaft during the swing). Under these circumstances there is a great deal of predictive uncertainty about the feasibility and performance of proposed new shafts. Thus my shaft designs are mostly the result of experimentation and a costly and time consuming process of trial and error.

BRIEF DESCRIPTION OF THE DRAWINGS

FIG. 1 is a Bill of Material showing how to fabricate my shaft in various lengths needed to assemble a set of golf club irons having shafts with an S flex characteristic.

DETAILED DESCRIPTION OF THE INVENTION

Before proceeding to further describe the invention, I would like to explain how I distinguish the various flex patterns for shafts. The terms for shaft flex usually used in the industry, Extra Stiff (X), Stiff (S), Regular (R) and Ladies (L), are relative terms for a particular shaft type and do not have an absolute definition agreed upon to cover all types of shaft. Therefore let me explain that for this invention I have been measuring shaft flex with the test shown diagramatically in FIG. 10.

Shaft Deflection Test

Figure 10:
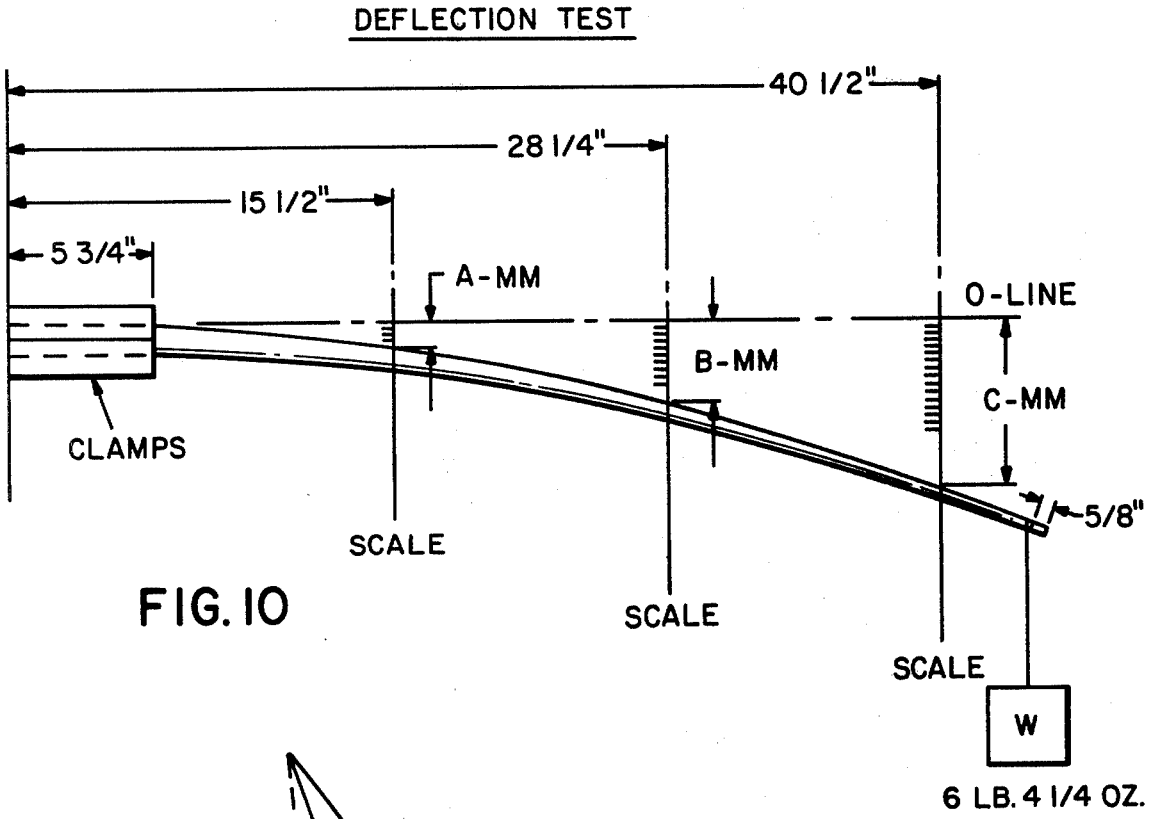
FIG. 10 is side diagramatic view of an apparatus for measuring the Deflection Curve of a golf club shaft under a standard load.

In FIG. 10 a shaft has been horizontally clamped at its grip end and loaded with a 6 lb. 4¼ oz. weight hung ⅝ inch from its hosel end. Previously the unloaded horizontal cantilever position of the shaft was determined to define a "0" line from which the loaded shaft deflection can now be measured (in millimeters) at three specified horizontal distances (A, B, C) from the shaft's grip end. The three specified horizontal distances are:

| | |
|---|---|
| A | 15½ inches |
| B | 28¼ |
| C | 40½ |

Thus, by means of the test of FIG. 10 any shaft can be said to have characteristic deflection readings which then can be correlated with golfers' reactions to the shaft as being of extra stiff, stiff, regular, or ladies flex.

In designing my new shaft I started with a very popular standard weight shaft, Propel II TM, whose deflection characteristics were known to be acceptably labeled as follows:

| Flex | Shaft Length | Deflection (MM)±5MM A | B | C |
|---|---|---|---|---|
| S | 44" | 13 | 62 | 140 |
| R | 44" | 14 | 65 | 150 |
| L | 44" | 15 | 72 | 167 |

I then experimented with the parameters of my new shaft, particularly the taper applied to the shaft from handle to hosel end, so as to closely approximate the familiar Propel II TM deflection pattern. This resulted in the following measured deflection readings for the UCV-304 TM.

TABLE II

| Flex | Shaft Length | Deflection (MM)±5MM A | B | C |
|---|---|---|---|---|
| X | 45" | 13 | 57 | 127 |
| S | 44" | 14 | 60 | 134 |
| R | 44" | 15 | 65 | 146 |
| L | 44" | 17 | 74 | 166 |

In practice I have found that the above deflection readings for the UCV-304 TM are meaningful to golfers in that the flex labels X, S, R and L applied to shafts give a good indication of how the shaft will play in terms of stiffness when compared with well known previously existing shafts, such as Propel II TM.

Figure 11:
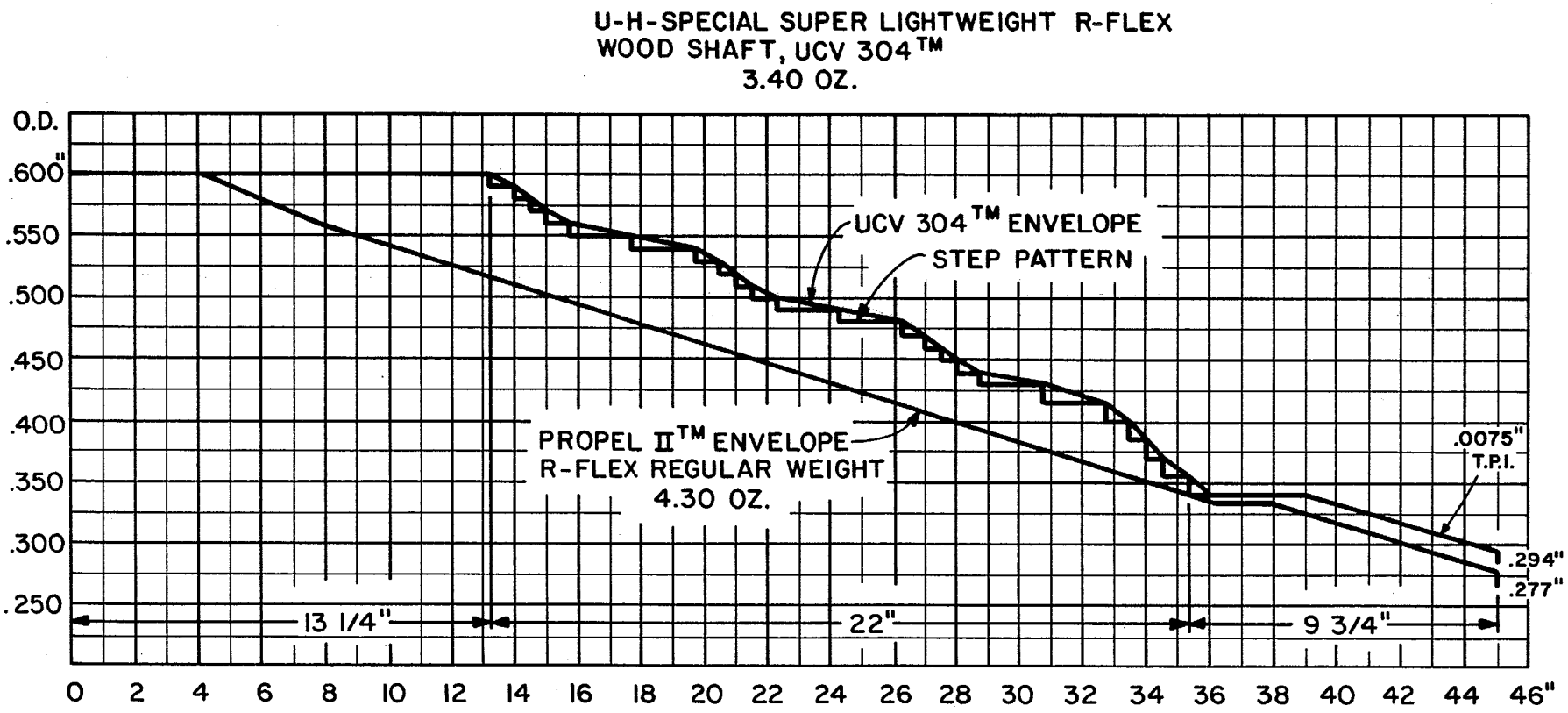
FIG. 11 is a graphical solution to the problem of selecting the taper of my golf club shaft so that the shaft can be 45 inches long, 3.4 oz. in weight, have an R flex, and be suitable for assembly into a golf club wood head.

However, because the UCV-304 TM is made with unusually thin wall construction (because of its low weight), I had to modify the shaft taper considerably to achieve flex characteristics comparable to standard weight shafts like the Propel II TM. FIG. 11 shows outside shaft diameter (plotted vertically) versus distance along a 45" shaft (plotted horizontally) for a Propel II TM R flex wood shaft (envelope only) and for my UCV-304R flex wood shaft (both the actual step pattern and the envelope).

Note that while some shafts are manufactured to taper smoothly from handle end to hosel end, it is more common for shafts to be tapered in quantized "steps," resulting in a characteristic "step pattern" for each type of shaft. In practice, the actual "steps" of a step pattern can be used to identify a particular shaft model and (if chosen carefully) enhance its appearance, while the "envelope" of the step pattern characterizes the major physical effect of the step pattern on the shaft flex and other play characteristics of the shaft.

Thus in making the comparison of FIG. 11 only the relatively smooth envelope of the Propel II TM R flex step pattern is shown compared with the envelope and actual step pattern of my UCV-304 TM shaft. It can readily be seen that the envelopes of the two step patterns diverge considerably because my step pattern begins its taper about 9" further towards the hosel end of the shaft and then proceeds at a much faster taper than the standard weight Propel II TM (i.e. the outside diameter (O.D.) of my UCV-304 TM shaft tapers from 0.600 to 0.340 inches along just 22 inches of shaft length, compared to about 31 inches of shaft length used for an approximately comparable decrease in the outside diameter of the Propel II TM shaft).

Figure 12:
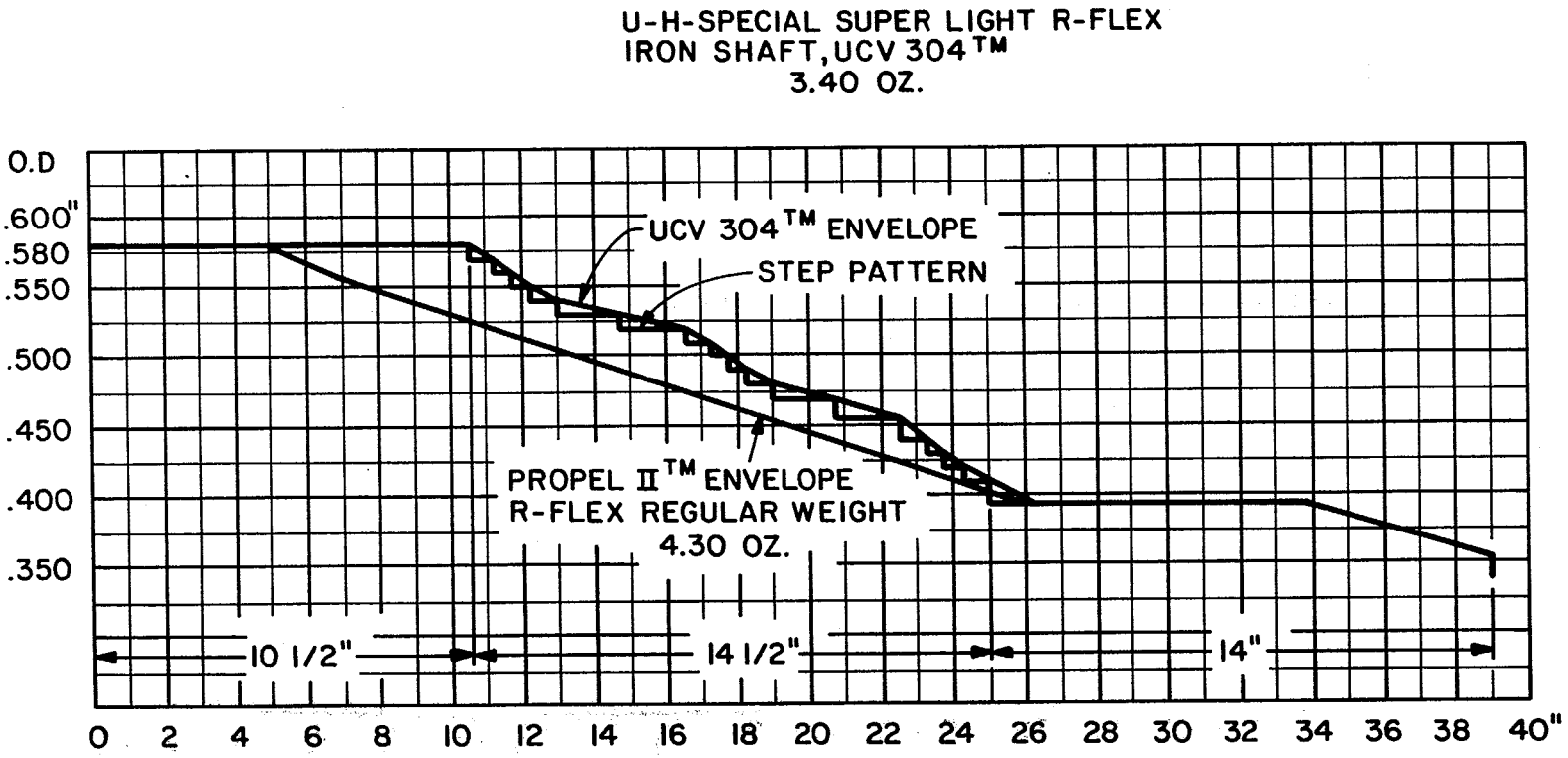
FIG. 12 is a graphical solution to the problem of selecting the taper of my golf club shaft so that the shaft can be 39 inches long, 3.4 oz. in weight, have an R flex, and be suitable for assembly into a golf club iron head.

Similarly, FIG. 12 shows outside shaft diameter (plotted vertically) versus distance along a 39" shaft (plotted horizontally) for the outer envelope of a Propel II TM R flex iron shaft and the actual step pattern and outer envelope of the pattern for my UCV-304 TM R flex iron shaft. In this case the envelopes of the two step patterns also diverge considerably because my UCV-304 step pattern begins its taper about 5½ inches further toward the hosel end of the shaft than the Propel II and then proceeds at a much faster taper than the regular weight club.

Thus in FIGS. 11 and 12 the envelope of my novel step pattern gives the solution which I found by experimentation and trial and error to make a 3.4 oz. shaft have a flex pattern characteristic similar to that of a 4.4 oz. regular weight shaft. Of course, in both cases the envelope is only an imaginary line connecting the actual step pattern of my club. However, it is the envelope of the steps which gives the shaft its characteristic flex pattern if the actual individual steps are relatively shallow and close together as is the case with my step pattern; in such a case, a variety of step patterns having the same envelope will tend to cause the same pattern of shaft flex, even though the individual step patterns may differ quite noticeably.

Therefore, whenever in this Specification I give a particular step pattern as the solution to the problem of obtaining a desired flex in a given shaft, it is to be understood my solution includes all equivalent patterns; that is, all step patterns having substantially the same envelope.

Figure 6:
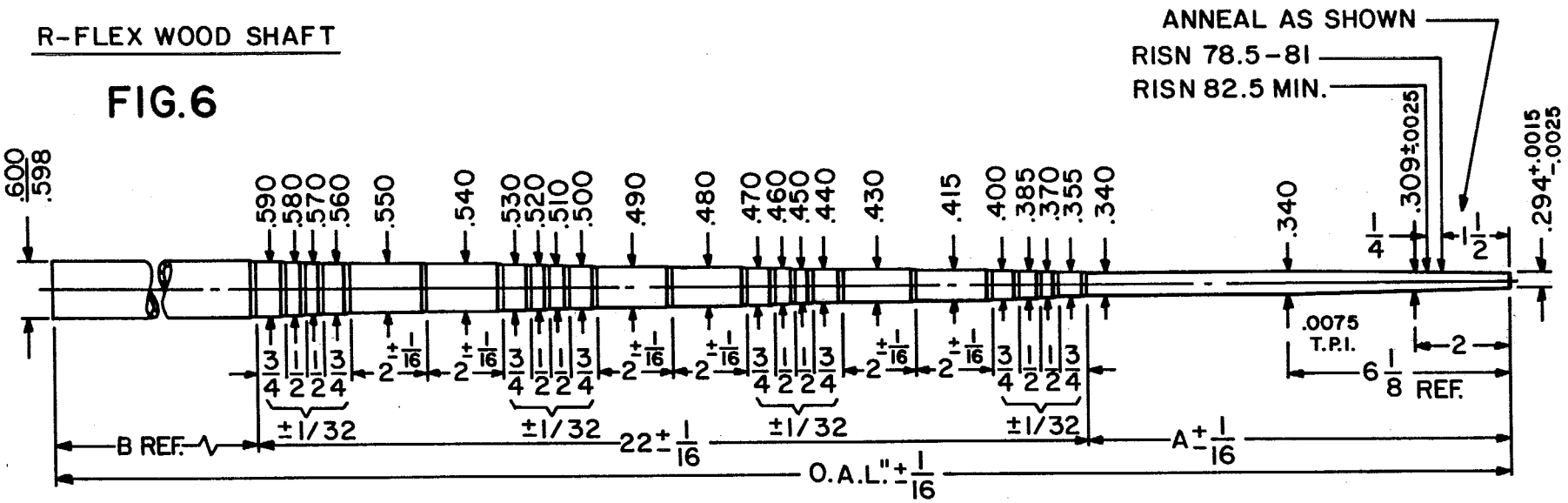
FIG. 6 is a Bill of Material showing how to fabricate my shaft in various lengths needed to assemble a set of golf club woods having shafts with an R flex characteristic.
Figure 7:
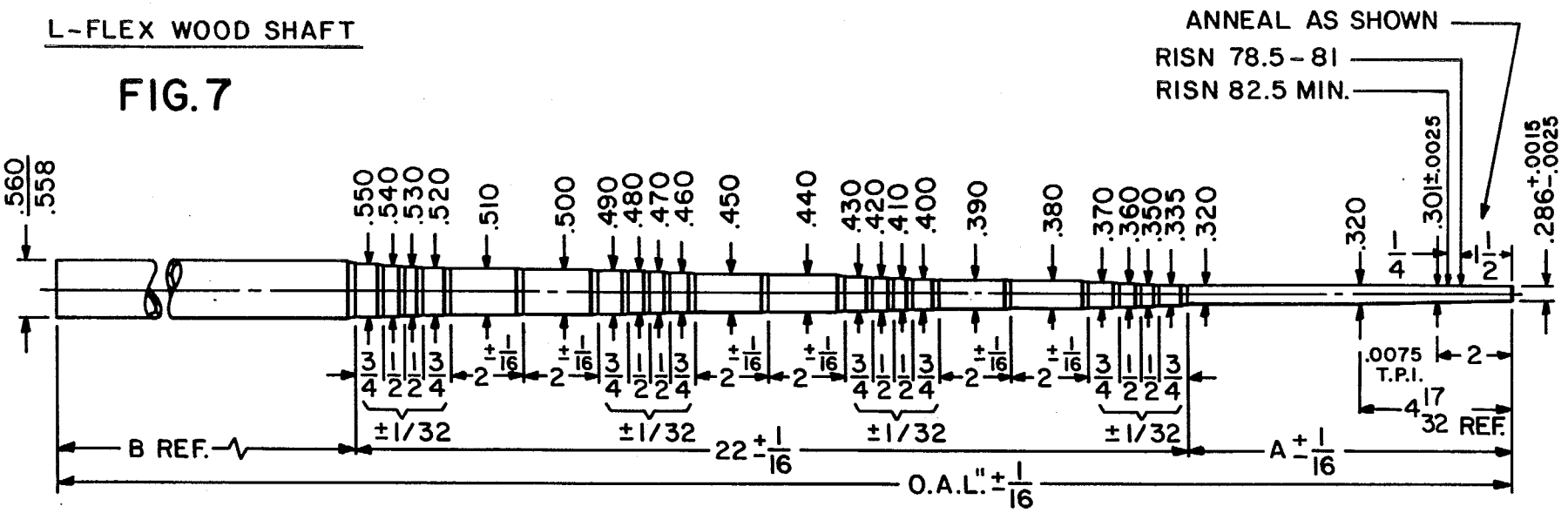
FIG. 7 is a Bill of Material showing how to fabricate my shaft in various lengths needed to assemble a set of golf club woods having shafts with an L flex characteristic.

However, the particular step pattern for my shaft shown in FIGS. 11 and 12 (and repeated with some variation throughout FIGS. 1-7) does have some special characteristics in addition to its carefully selected envelope. This can most easily be seen in FIGS. 6 and 2 which illustrate step patterned shafts following the designs of FIGS. 11 and 12 respectively. It is immediately apparent from FIGS. 6 and 2 that my step pattern is able to fit within the desired envelope while producing a regular, pleasing appearance on the shaft. My steps have a minimum depth of about 0.010 inch to assure that they will be easily visible on the finished shaft and rarely exceed 0.020 in depth. The steps fall quite naturally into three sizes distinguished by their length along the shaft:

| | |
|---|---|
| Small | 0.50 inch |
| Medium | 0.75 inch |
| Large | 1.75 or 2.0 inch |

I consistently repeat the small and medium steps in the subpattern "medium-small-small-medium" and the large steps in the subpattern "large-large." Joined together these two subpatterns appear as "medium-small-small-medium-large-large" a cycle that appears twice or more on each shaft (depending on the shaft length) to give each shaft both a distinctive appearance and the envelope required for the designed flex pattern. For example, see FIG. 1, where starting from the left (grip) end of the shaft the lengths of the steps are: medium (0.75 inch), small (0.50 inch), small, medium, large (1.75 inch), large.

Turning now to the problem of fabricating clubs of the above design, to meet all the various objectives of my invention I had to discover:

(a) criteria for selecting metals for my shaft tubes that would not become permanently bent in play or brittle enough to break in play (b) test criteria for the finished light weight shafts that would permit me to reject shafts that were defective and might bend or break in play (c) how big to make each starting work piece so that I could give it the desired step pattern, size and weight, taking into account that tapering a shaft tube will increase its length, while trimming the ends of the shaft to achieve the finished length (after tapering) will reduce its weight (d) how to modify my answers to (a), (b) and (c) above to produce shafts suitable for
(i) wood heads and iron heads
(ii) clubs of different shaft length
(iii) clubs of different shaft flexes.

Once again I proceeded by experimentation and trial and error to solve these fabrication problems. The results of my efforts are summarized in FIGS. 1–8, each of which is a Bill of Material for fabricating a particular shaft, usually in a range of lengths.

FIG. 1, for example, is the Bill of Material for an S flex shaft designed for iron heads, the finished shaft length varying in ½ inch steps from 39½ inches to 35 inches. While FIG. 1 specifies that the shaft is to be made of AISI 6150 alloy steel seamless tubing, in fact welded tubing may be used. The advantage of seamless tubing is merely that if you are willing to pay its premium price, forming and welding of flat strip stock into tubing (and the problems of getting a good weld) can be avoided altogether.

Similarly, while I have found that AISI 6150 alloy steel is very satisfactory for fabricating my shafts, the general criteria for the metal of my shafts is that in spite of the thin walls of my shafts the metal must not cause the shaft to become permanently bent or break due to brittleness when used by the average golfer. In practice I have found that these criteria can be met by metals that have, after heat treatment, a yield strength equal to or greater than 220,000 lbs./in.$^2$ and an ultimate strength equal to or greater than 240,000 lbs./in.$^2$ AISI 6150 alloy steel is such a metal, and other examples are AISI 4150, 4340, 5150, 8650 alloy steels.

Returning now to FIG. 1, the initial size of each workpiece is specified so that after step forming, hosel swaging, and cutting to finished length, the shaft will have both the desired dimensions and the desired weight. In the FIG. "O.A.L." is the Overall Length of the shaft, "REF." is a Reference distance from an indicated shaft end, and "A" labels the portion of the shaft length remaining at the hosel end below the step of smallest outside diameter. My initial tube sizes and weights have been selected so that after the steps have been formed and the hosel swaged, about ½ inch can be trimmed from the grip end of the shaft and about 1 inch from the hosel end; thus, irregularities introduced at the tube ends during manufacture are trimmed away.

Figure 2:
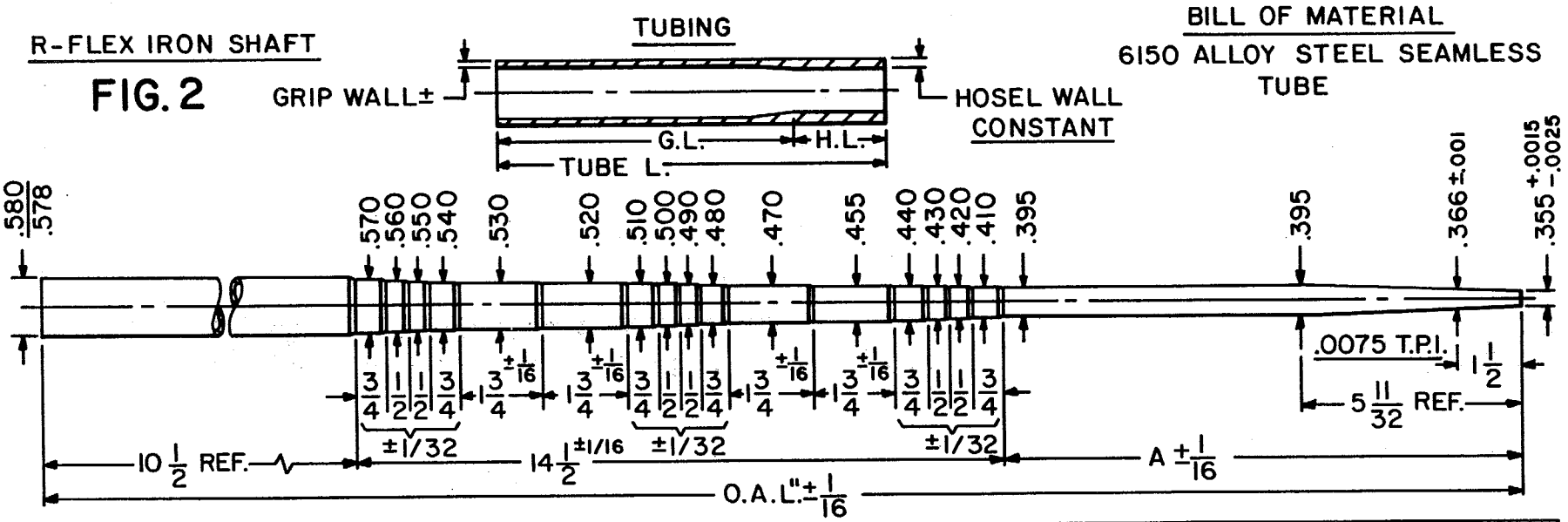
FIG. 2 is a Bill of Material showing how to fabricate my shaft in various lengths needed to assemble a set of golf club irons having shafts with an R flex characteristic.
Figure 3:
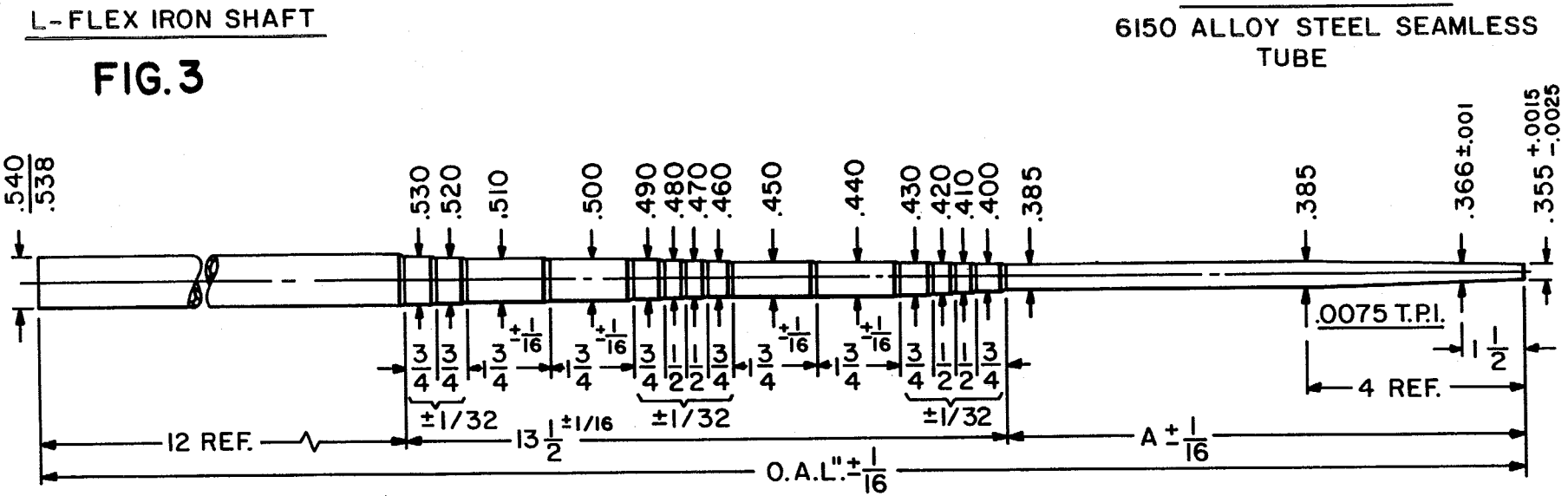
FIG. 3 is a Bill of Material showing how to fabricate my shaft in various lengths needed to assemble a set of golf club irons having shafts with an L flex characteristic.
Figure 4:
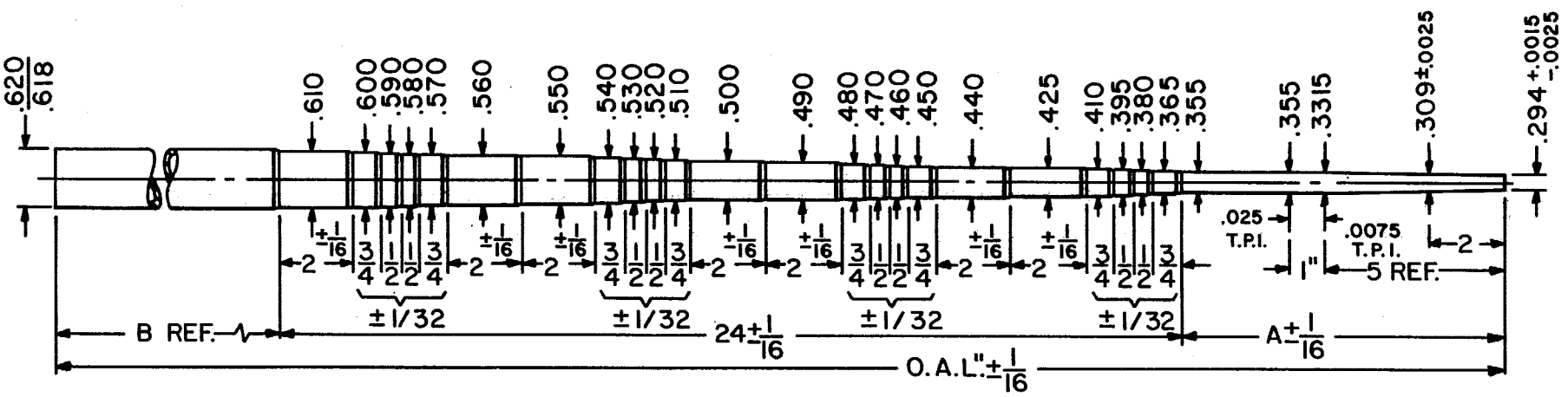
FIG. 4 is a Bill of Material showing how to fabricate my shaft in various lengths needed to assemble a set of golf club woods having shafts with an X flex characteristic.
Figure 5:
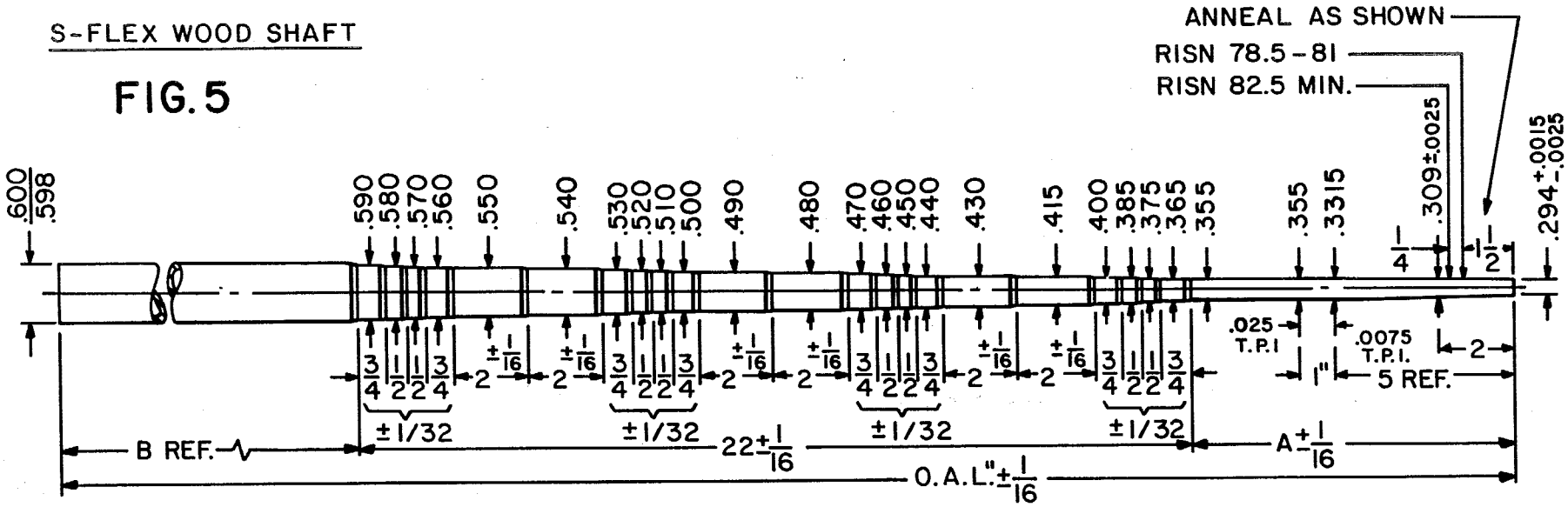
FIG. 5 is a Bill of Material showing how to fabricate my shaft in various lengths needed to assemble a set of golf club woods having shafts with an S flex characteristic.

Another feature of my invention which appears in my S and R flex shafts for clubs with iron heads is that the initial workpiece is specified to have a slightly thicker wall so that the final shaft will have a slightly thicker hosel to improve its performance on the permanent set test (this permanent set test will be described below). As can be seen at the top of FIGS. 1 and 2, the length of the thicker portion of the workpiece is designated by the initials "H.L.", while the thinner main portion of the workpiece is designated "G.L.".

While the basic operations for forming and finishing my UCV-304 TM tube (given the specified bill of materials) generally follow the procedure for making a standard weight tube, those practicing my invention will probably find it necessary to make the following additions and adjustments to operations originally designed for tubes of standard weight because of the tube's thin wall and the higher strength of the material used:

(a) additional steps for weighing and measuring the initial workpiece and final shaft should be introduced to assure that the tube stays within the specified tolerances (b) to reduce any hardness introduced while forming the workpiece, an additional annealing step may be added just before the shaft steps are formed, the additional annealing step consisting of heating the workpiece to 1250° F. and slowly cooling it to ambient temperature (c) the steps for hosel swaging and shaft straightening may be performed at speeds slower than those used for standard weight tubes (d) stress relief steps may be introduced both before and after plating the shafts, the stress relief consisting of placing the shafts in an oven for one hour at 450° F.

(e) additional hand alignment of the shaft before final stress relief steps may be added When the metal used is a carbon alloy steel, such as 6150 alloy steel, the initial workpiece should preferably have a sphereodized fine structure and the Austemper type heat treatment of the shaft (after forming the steps and swaging the hosel end) should produce a banite structure in the final shaft.

Impact Test

Figure 8:
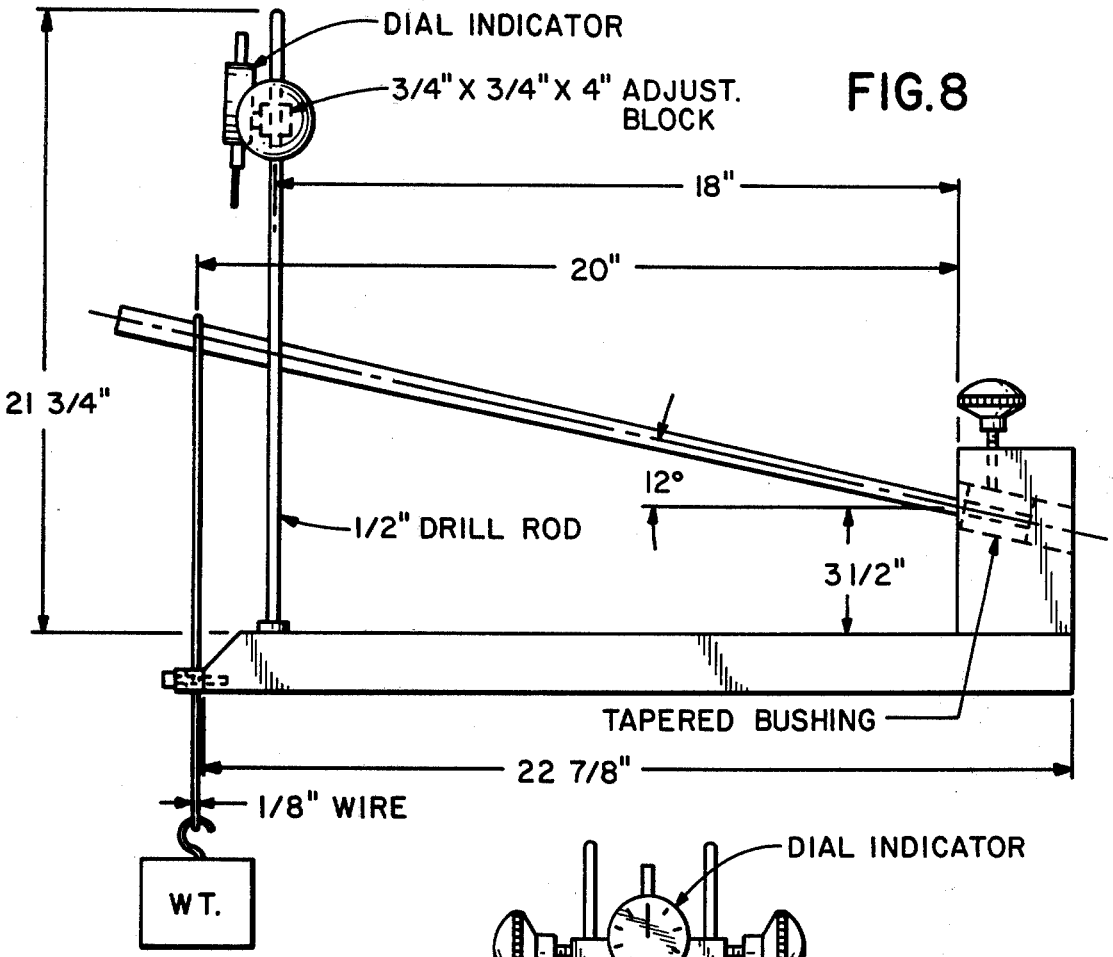
FIG. 8 is a side diagramatic view of an apparatus useful in performing a Permanent Set Test useful in controlling playing characteristics of clubs made with my invention.
Figure 9:
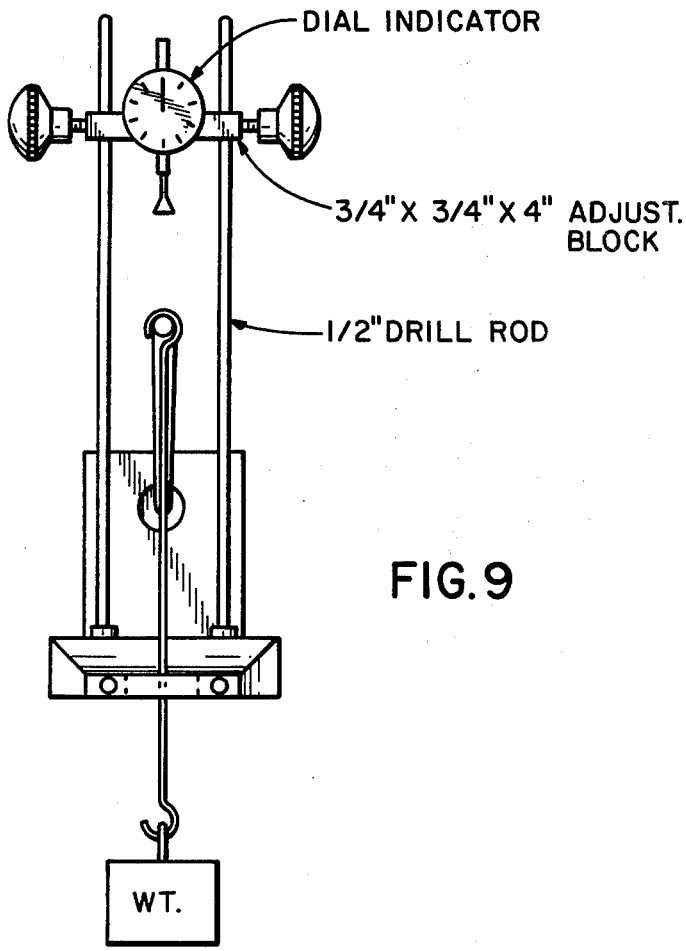
FIG. 9 is an end diagramatic view of the apparatus of FIG. 8 as viewed from the left end.

There are two tests that I perform on my completed shafts to assure that they will be suitably resilient and durable when used by average golfers. In FIGS. 1–7 permanent set criteria (W, S) are given for each shaft. FIGS. 8 and 9 are a side and end view of the Permanent Set Test I use to check that the criteria have been met. Briefly, the test apparatus consists of an adjustable clamp for clamping the hosel end of the shaft (protected by a matching steel bushing of length B inches having a club head hosel-simulating bore) at 12° from the horizontal. Then a specified weight of W lbs. is applied for 60 seconds to the grip end of the shaft and the permanent deflection the shaft experiences is measured in inches. In my shafts this permanent set deflection of S inches must preferably not exceed 0.100 inches to assure that normal use will not put a noticeable permanent bend in the shaft.

In greater detail, the Permanent Set Test is performed as follows:

1. The appropriate matching hosel bushing of length B inches is inserted into the set test fixture and locked into place so that the lower edge of the bushing is flush with the set test fixture.
2. The shaft is inserted into the hosel bushing, in the fixture, and twisted to assure proper alignment with the dial indicator stem and to insure a tight fit in the bushing.
3. The dial indicator is then brought down, on its support rods, and the indicator stem depressed against the stem, locked into position with a reading of 0.600" on the revolution counter. The bezel is then rotated to bring the indicator pointer to zero.
4. The specified test load weight of W lbs. is then applied by means of the standard weight hook at a point 20" from the test bushing and slowly lowered by hand and then released.

5. At the end of 60 seconds, the test load is removed and the shaft moved up slowly—guided by hand—again contacting the indicator stem until upward movement of the shaft stops.
6. The indicator is then read in increments of 0.001" with the difference between the initial 0.600" reading and the present reading being the amount of permanent set S in inches.

Figure 13:
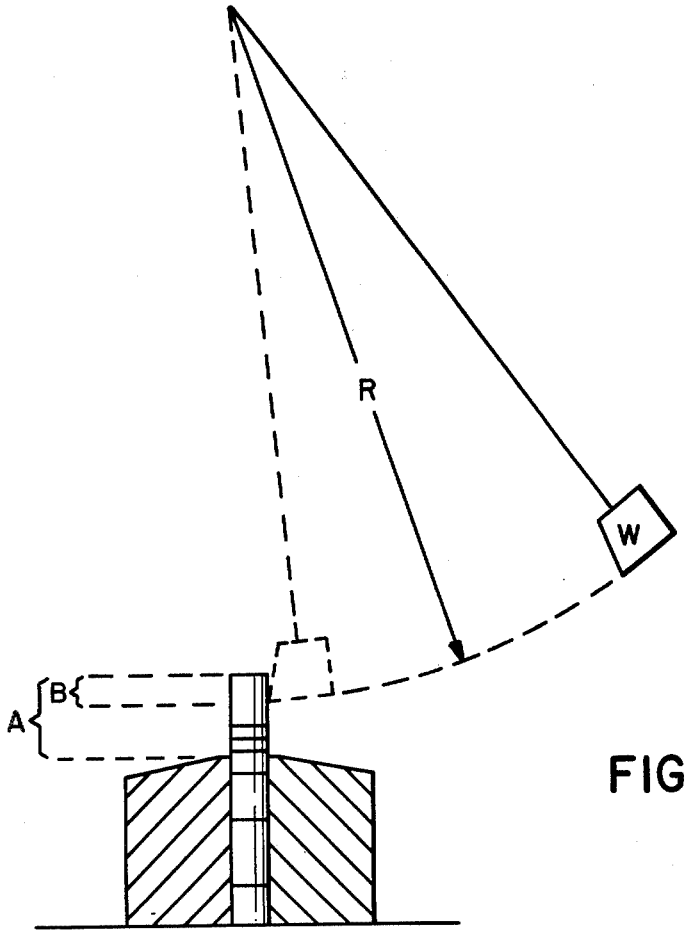
FIG. 13 is a diagramatic view of a modified Izod impact test for measuring the impact resistance of my shaft.

The second test that I apply to my finished shafts is the modified Izod impact test shown diagramatically from the side in FIG. 13. Briefly, 5 inch lengths cut from various portions of my shaft are clamped vertically to project a distance A of 1¾ inches above a vice and subjected to a horizontal blow by a weighted, swinging pendulum steel edge W at a point A about ¾ inches from its end. The starting potential energy of the pendulum W is known and always chosen to exceed that necessary to break the shaft. In overcoming the shaft's resistance to breakage, the pendulum loses kinetic energy and this loss of energy can be read by means associated with the test equipment but not shown in FIG. 13 to give the shaft's resistance to impact in ft.-lbs.

In practice I perform my impact tests on an Olsen Universal Impact Testing Machine manufactured by Tinius Olsen Testing Machine Company of Philadelphia, Pa. Empirically I have discovered that tubes of my design should preferably have an impact resistance of at least 10 ft.-lbs. so that they are certain to stand up in normal use.

While so far in this description I have mostly relied on FIG. 1 to describe my new lightweight shaft and its method of manufacture what I have said about FIG. 1 applies mutatis mutandis to the shaft designs of FIGS. 2–7 so my shaft can be manufactured in a great variety of lengths and flexes.

It should be noted that while I have referred to my shaft as being of about 3.4 oz. in weight, in fact by using slightly modified designs I have been able to produce shafts of my design as light as 2.9 oz., but these shafts performed so poorly on the impact test that I felt that they were not rugged enough to sell to golfers generally, though they played well enough to satisfy golfers who would treat them with special care. Thus, my choice of a 3.4 oz. club was made so that the advantages of the club would be available to average golfers without concern for shaft breakage under extreme conditions (such as where the golfer accidently abuses the shaft).

Although in describing the embodiments shown in FIGS. 1–7 I have been very specific in citing details to aid those skilled in the art in replicating my shaft and have called attention only to some of the most prominent advantages and characteristics, my invention includes other embodiments reasonably equivalent within the spirit of the invention and has other advantages that will be readily apparent to those skilled in the art when reading this specification.

I claim:

1. A light weight metal golf club shaft having performance and playing characteristics similar to conventional weight carbon steel alloy shafts, the shaft weight having the relationship to clubhead type and shaft flex shown in Table 1 wherein the shaft consists essentially of a metal wherein the metal has, after heat treatment, a yield strength equal to or greater than 220,000 lbs./in.$^2$ and an ultimate strength equal to or greater than 240,000 lbs./in.$^2$.

2. The shaft of claim 1 where the metal is selected from the group consisting of AISI 6150, 4150, 4340, 5150 and 8650 alloy steels.

3. The shaft of claim 1 wherein the shaft has a permanent set less than or equal to 0.001 inches as determined by the test method hereinbefore described and the shafts resistance when subject to the impact test as hereinbefore described is at least 10 ft-lbs.

4. The shaft of claim 1 where the shaft is tapered with a step pattern having an envelope which corresponds to the envelope of the step pattern chosen from the group of step patterns specified in FIGS. 1–7.

5. The shaft of claim 4 wherein the envelope is the envelope of the step pattern of FIG. 1.

6. The shaft of claim 4 wherein the envelope is the envelope of the step pattern of FIG. 2.

7. The shaft of claim 4 wherein the envelope is the envelope of the step pattern of FIG. 3.

8. The shaft of claim 4 wherein the envelope is the envelope of the step pattern of FIG. 4.

9. The shaft of claim 4 wherein the envelope is the envelope of the step pattern of FIG. 5.

10. The shaft of claim 1 where the shaft is tapered with a step pattern chosen from the group of step patterns specified in FIGS. 1–7.

11. The shaft of claim 10 wherein the step pattern is the step pattern of FIG. 1.

12. The shaft of claim 10 wherein the step pattern is the step pattern of FIG. 2.

13. The shaft of claim 10 wherein the step pattern is the step pattern of FIG. 3.

14. The shaft of claim 10 wherein the step pattern is the step pattern of FIG. 4.

15. The shaft of claim 10 wherein the step pattern is the step pattern of FIG. 5.

* * * * *